US009955810B1

(12) United States Patent
Diederich

(10) Patent No.: US 9,955,810 B1
(45) Date of Patent: May 1, 2018

(54) DEVICE FOR HOLDING A STEMMED GLASS

(71) Applicant: Gregory Roger Diederich, Green Bay, WI (US)

(72) Inventor: Gregory Roger Diederich, Green Bay, WI (US)

( * ) Notice: Subject to any disclaimer, the term of this patent is extended or adjusted under 35 U.S.C. 154(b) by 0 days. days.

(21) Appl. No.: 14/590,890

(22) Filed: Jan. 6, 2015

Related U.S. Application Data

(60) Provisional application No. 61/924,680, filed on Jan. 7, 2014.

(51) Int. Cl.
*A47G 23/02* (2006.01)

(52) U.S. Cl.
CPC ..... *A47G 23/0225* (2013.01); *A47G 23/02* (2013.01); *A47G 23/0216* (2013.01); *A47G 23/0233* (2013.01)

(58) Field of Classification Search
CPC .. A47G 23/0225; A47G 19/06; A47G 19/065; A47G 19/08; A47G 23/0208; A47G 23/0233; A47G 23/0216; A47G 23/02; A47D 1/008
USPC .... 248/316.7, 316.1, 312.1, 312, 313, 311.2, 248/309.1, 914
See application file for complete search history.

(56) References Cited

U.S. PATENT DOCUMENTS 556,200 A * 3/1896 McDonald ..... A47G 23/0225 220/737
1,063,321 A 6/1913 Blackwell
1,987,896 A 1/1935 Ericsson
2,719,414 A * 10/1955 Davis ..... A47G 23/0225 220/23.83
2,781,992 A * 2/1957 Cunningham ..... A24F 19/0092 131/241
3,089,211 A * 5/1963 Perusse ..... A47G 21/167 24/555
4,766,653 A * 8/1988 Della Porta ..... H01L 23/4006 24/563
4,860,895 A * 8/1989 Iaslovits ..... A47G 23/0633 206/426
4,961,555 A * 10/1990 Egan, Jr. ..... A47G 23/0225 211/41.2
D322,194 S * 12/1991 Egan, Jr. ..... D7/708.1
(Continued)

OTHER PUBLICATIONS

Winerest Pty Ltd, printout of web page www.winerest.com as viewed on Nov. 21, 2104 (2 pages).
(Continued)

*Primary Examiner* — Nkeisha Smith
(74) *Attorney, Agent, or Firm* — Brannen Law Office, LLC

(57) ABSTRACT

The present invention relates to a device for holding a stemmed glass and in particular to a holder attachable to a camping style chair or other structure. The device, in one embodiment has a holder with an opening for supporting a stemmed glass. A top piece is integral with the holder and is generally coplanar therewith. A bottom piece acts as a spring. In this regard, the bottom spring piece can be separated from the top piece wherein it can clamp onto a chair arm bar or other surface (round or flat). The top piece has an arched inside surface with two parallel rails. The bottom piece has a notch therein. In a second embodiment, a wire device is provided having a holder, a first arm, a second arm, a third arm and a lever.

13 Claims, 12 Drawing Sheets

(56) References Cited

U.S. PATENT DOCUMENTS 5,074,508 A * 12/1991 Powers ..... B60R 7/10 211/31
5,160,339 A * 11/1992 Chen ..... A61B 17/0487 227/902
5,397,089 A 3/1995 Kataoka
5,720,516 A 2/1998 Young
5,865,412 A 2/1999 Mason
6,447,730 B1 * 9/2002 Kuchar ..... A61B 10/007 215/395
6,682,034 B1 * 1/2004 Vial ..... A47G 19/04 248/231.81
7,284,737 B2 * 10/2007 Kane ..... A47G 23/0225 248/226.11
7,708,248 B2 5/2010 Lagobi
7,959,121 B1 * 6/2011 Barnes, Jr. ..... A47G 23/0225 224/148.4
8,136,667 B2 * 3/2012 Raynor ..... A47G 19/06 206/217
8,636,319 B1 * 1/2014 Parker, Jr. ..... A47C 7/62 248/311.2
8,820,572 B2 * 9/2014 Miller ..... B65D 25/20 206/217
2002/0109062 A1 * 8/2002 Fowler ..... B62J 11/00 248/311.2
2011/0121619 A1 5/2011 Chappell
2012/0138505 A1 * 6/2012 Raynor ..... A47G 23/0225 206/564
2013/0105650 A1 * 5/2013 Cohen ..... A47G 23/0225 248/229.26

OTHER PUBLICATIONS

Wine Glass Plate Clips, as viewed on web page http://www.drinkstuff.com/products/product.asp?ID=5712#.VG-HGfnF8Xs on Nov. 21, 2014 (3 pages).
Trekwise, Wine Glass Clamp, as viewed on web page http://trekwise.co.uk/wine-glass-clamp-450-p.asp on Nov. 21, 2014 (1 page).
10PCS Table Glass Water Cups Clip Drinklip Cup Holder Glass Holder Mug Office Tumblerful Glass Clamp, as viewed on web page http://www.dhgate.com/product/10pcs-table-glass-water-cups-clip-drinklip/140070607.html on Nov. 21, 2014 (3 pages).

* cited by examiner

DEVICE FOR HOLDING A STEMMED GLASS

This United States utility patent application claims priority on and the benefit of provisional application 61/924,680 filed Jan. 7, 2014, the entire contents of which are hereby incorporated herein by reference.

BACKGROUND OF THE INVENTION

1. Field of the Invention

The present invention relates to a device for holding a stemmed glass and in particular to a holder attachable to a camping style chair or other structure.

2. Description of the Related Art

Many people enjoy drinking beverages from stemmed glassware. Wine in particular is one example. Yet, in many situations, it is impractical or undesirable to use stemmed glassware. One example is when folding or camping style chairs are being used. The camping chairs have arms with integrated cup or bottle holders. Yet, these holders are not compatible with stemmed glassware.

Several items have been developed for use with cup holders, chairs, surfaces or other devices. Some examples include:

U.S. Pat. No. 1,063,321 to Blackwell is titled Buffet Server.

U.S. Pat. No. 1,987,896 to Ericsson is titled Tea Ball Holder.

U.S. Pat. No. 4,961,555 to Egan, Jr. is titled Glass Holder. It shows a stemware holder for engaging the rim of a plate comprising a slotted bowl for receiving a stemware. A flange is attached to the top of the bowl. Two bent clip elements attached to the edge of the flange and a lower clip element is attached to the bottom of the bowl. An L-shaped gusset connects the top clip elements to the bottom element stiffening the clips and moving the flex point from the juncture with the flange to the bends in the clip. This strengthens the clips and permits wider flexing to receive thicker plates without cracking or breaking.

U.S. Pat. No. 5,397,089 to Kataoka is titled Glass Holder. It shows that a glass holder is provided which is used to hold a glass stably at the edge of a dish. It has a glass holding body shaped like a cup and a cylindrical mounting frame vertically extending from the underside of the bottom of the glass holding body. The mounting frame is cut horizontally halfway around to form a mounting section so that the edge of a dish can freely be inserted into or removed from the mounting section.

U.S. Pat. No. 5,720,516 to Young is titled Concession Goods Holder. It shows a concession goods holder for attachment to a cup holder such as in the end of a stadium or theater seat armrest. The concession goods holder is preferably made from resilient plastic and is in the form of a U-shaped bracket open at the sides and top for clasping and retaining concession goods such as a popcorn bag. The holder has a laterally extending arm terminating in a step-sided cup holder sized for engagement with the cup holder arm end of a stadium or theater seat armrest. This arrangement permits the user to employ the device for holding both a drink and a bag of popcorn from the concession stand.

U.S. Pat. No. 5,865,412 to Mason is titled Beverage Container Holder. It shows a beverage container holder to be removably attached to an armrest of a chair includes an arm member and a receptacle on one end of the arm member to receive and support a beverage container in a stable manner. A flexible, generally U-shaped retainer is on the opposite end of the arm member and is configured to engage the armrest to secure the beverage container holder to the armrest. The receptacle includes a base, at least one upright wall extending generally about the periphery of the base and a slot provided in the upright wall. The slot extends downwardly from an upper rim of the upright wall to the base and also extends partially across the base.

U.S. Pat. No. 7,284,737 to Kane is titled Drink Holder. It shows that a drink holder system is described, wherein the drink holder system includes a base assembly operable to receive a drink container and a clamp assembly operably associated with the base assembly. The base assembly includes a C-shaped base member having an open end, a C-shaped retainer member having an open end, a plurality of leg members interconnecting the base member and the retainer member, and a plurality of selectively biasable prong members extending from a surface of the retainer member. The clamp assembly includes a bracket member operably associated with the retainer member, a first clamping member slidably received in the bracket member, and a second clamping member operably associated with the bracket member, wherein the second clamping member is operable to bias away from the first clamping member to permit the clamp assembly to selectively clamp onto a surface, such as an edge portion of a table or chair.

U.S. Pat. No. 7,708,248 to Lagobi is titled Container holder. The invention provides a device having a clamp-like structure with jaws designed to bite onto a support, and at least one of the handles shaped like a ring in order to serve as a receptacle for holding a cup-like container. A user may easily attach the device to a solid support in order to hold a liquid container. The holder may be used in work areas such as desks, tables and the like in order to prevent beverage spillage. The invention provides multiple designs that enable a device to adapt to supports with various thicknesses.

U.S. Pat. No. 7,959,121 to Barnes, Jr. is titled Adjustable Cup Holder. It shows an adjustable cup holder that incorporates an elongated clamp assembly and cup support assembly. The clamp assembly has a proximal end and a distal clamping end. The cup support assembly is connected at the proximal end of the clamp assembly, and comprises a body portion and a pair of arcuate cup-encircling arms having respective spaced-apart free ends. A pivot pin enables pivot adjustment of the cup support assembly at the proximal end of the clamp assembly, such that the cup support assembly is movable between a desired in-use position depending from the clamp assembly, and a folded stowed position beside the clamp assembly. In the stowed position, the clamp assembly passes between the spaced-apart free ends of the cup-encircling arms and into an area defined between the cup-encircling arms.

United States Publication Number 2011/0121619 to Chappell is titled Stemmed Glass Holder. A stemmed glass holder is provided, comprising an upper support section and a lower support section connected together by at least one flexible connector such as chain, the upper and lower support sections being generally circular in shape and comprising apertures in the perimeters thereof defining upper and lower cavities therein which are shaped and sized to accommodate a conventional stemmed glass, the glass holder further being pivotally and removably connected to a folding chair such that the glass holder may be folded into a compact configuration along with the chair for storage and transport when not in use.

A product sold under the name Wine Glass Clamp under product code KBCLAMP-BLU by Trekwise Ltd. Shows a clamp that can be fixed to an outdoor chair.

A product sold under the name Winerest by Winerest Pty Ltd. is a wine glass holder for a chair.

While each of the products described above may work well for their intended purposes, none show the present invention. Hence, there is a need for the present invention.

SUMMARY OF THE INVENTION

The present invention relates to a device for holding a stemmed glass and in particular to a holder attachable to a camping style chair or other structure. The device, in one embodiment has a holder with an opening for supporting a stemmed glass. A top piece is integral with the holder and is generally coplanar therewith. A bottom piece acts as a spring. In this regard, the bottom spring piece can be separated from the top piece wherein it can clamp onto a chair arm bar or other surface (round or flat). The top piece has an arched inside surface with two parallel rails. The bottom piece has a notch therein. In a second embodiment, a wire device is provided having a holder, a first arm, a second arm, a third arm and a lever.

According to one advantage of the present invention, the holder has a top piece with an interior arch. This advantageously allows the device to engage an arm rod of a chair and secure onto the fabric thereabout.

According to another advantage of the present invention, the arch slides over or moves relative to the arm rod. In this regard, being inserted along an axis of the rod, there is a sizable linear length of engagement between the arm or rod and the device (through the chair arm fabric). The device is unlikely to bend or twist off of the rod as it is supported longitudinally by the arm bar. The center of the holder is also aligned with the center of the arch advantageously resulting in no twisting forces (perpendicular to arm bar axis) being developed by the device that would cause the device to twist or rotate relative to the arm bar.

According to a further advantage of the present invention, the arch in the top piece provides structural integrity to the top piece. In this regard, the top piece is a generally rigid piece and is less likely to flex or bend along the longitudinal axis when compared to the bottom spring piece.

According to a still further advantage of the present invention, the arch has two sides or rails that are generally parallel to each other. In this regard, the top piece can securely contact a flat surface via engagement with the rails.

According to a still further advantage of the present invention, the holder lies in a holder plane that is generally parallel to or in line with the top piece longitudinal axis.

According to a still further advantage yet of the present invention, the bottom piece has a notch to securely engage a round surface.

According to a still further advantage yet of the present invention, the bottom has a flat portion on either side of the notch whereby the bottom piece can securely contact a flat surface.

According to a still further advantage of the present invention, the device is a unitary piece. Advantageously, even with a lack of multiple pieces, the device is able to be used with both round and flat surfaces of various diameters or thicknesses, respectively.

According to a still further advantage of the present invention, the bottom piece has an engagement portion that extends away from the top piece. This advantageously allows for a user to easily align the device with an intended object or surface wherein insertion onto an object can be easily accomplished along the longitudinal axis.

The holder advantageously remains in the same plane regardless of the amount of flex of the spring (bottom piece). In this regard, the holder functions well while being attachable to a wide range of objects and allows the holder opening to be at the distal end of the holder.

One advantage of an alternative embodiment is that it is made of a unitary wire construction. Another advantage of such a construction is the inclusion of lever arm. The lever arm allows the user to separate the third piece from the first piece and second piece wherein it can clamp onto an object. In the wire frame embodiment, the first piece and second piece engage (from the top side) the fabric on both sides of the arm bar and the lever engages the fabric on the bottom side of the frame bar. The arm bar provides strength to the device along the longitudinal axis whereby the holder is sufficiently supported to hold a stemmed glass.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
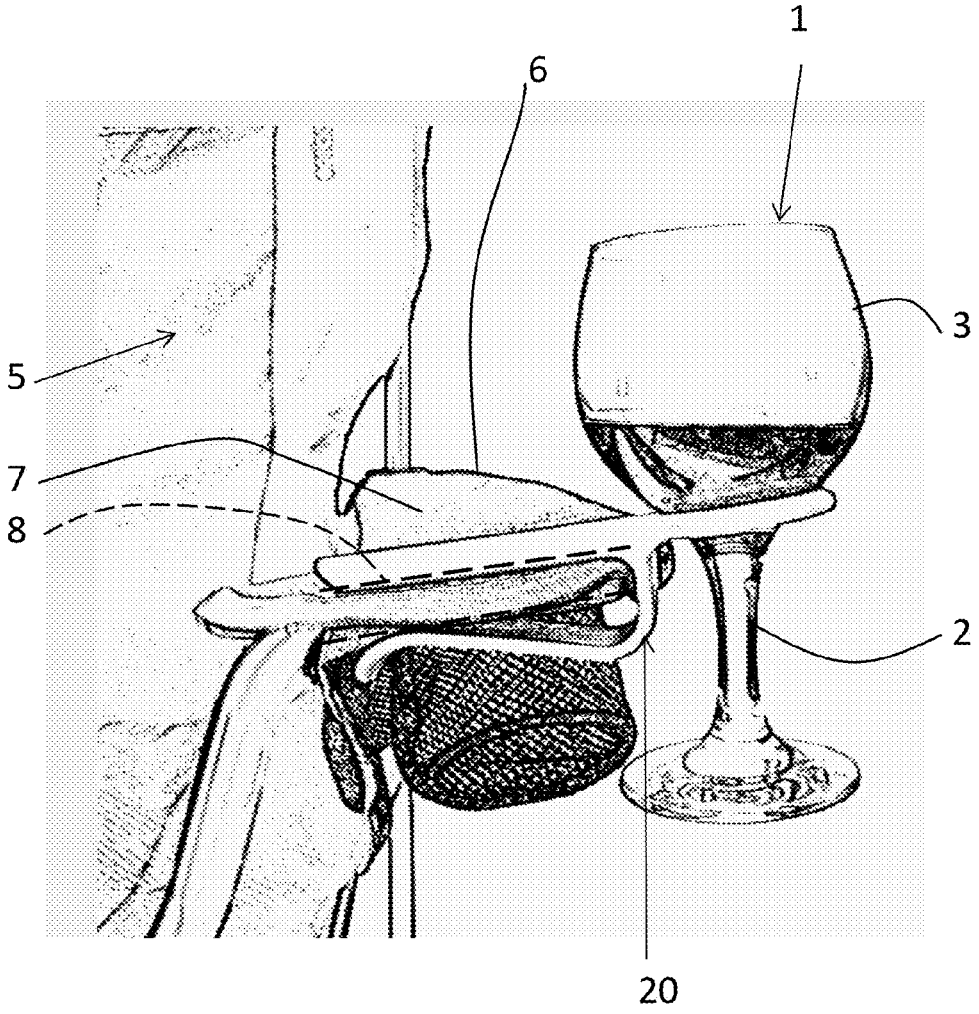
FIG. 1 is a view of a preferred embodiment of the present invention shown in an intended environment.
Figure 2:
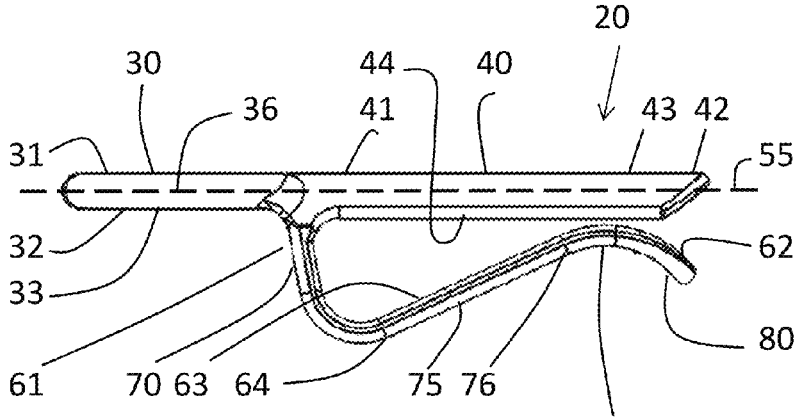
FIG. 2 is a side view of a preferred embodiment of the present invention.
Figure 3:
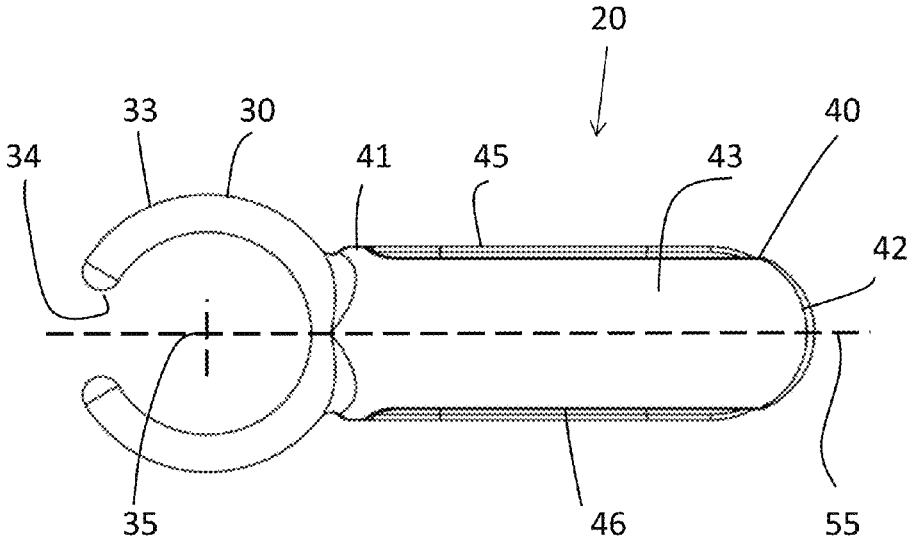
FIG. 3 is a top view of the preferred embodiment of the present invention illustrated in FIG. 2.
Figure 4:
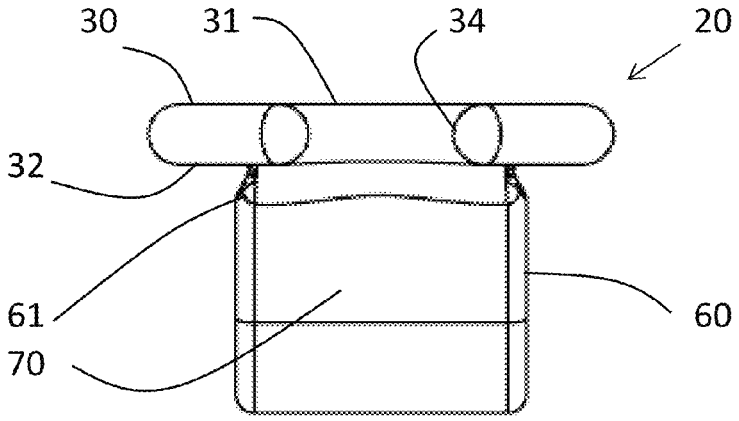
FIG. 4 is an end view of the preferred embodiment of the present invention illustrated in FIG. 2.
Figure 5:
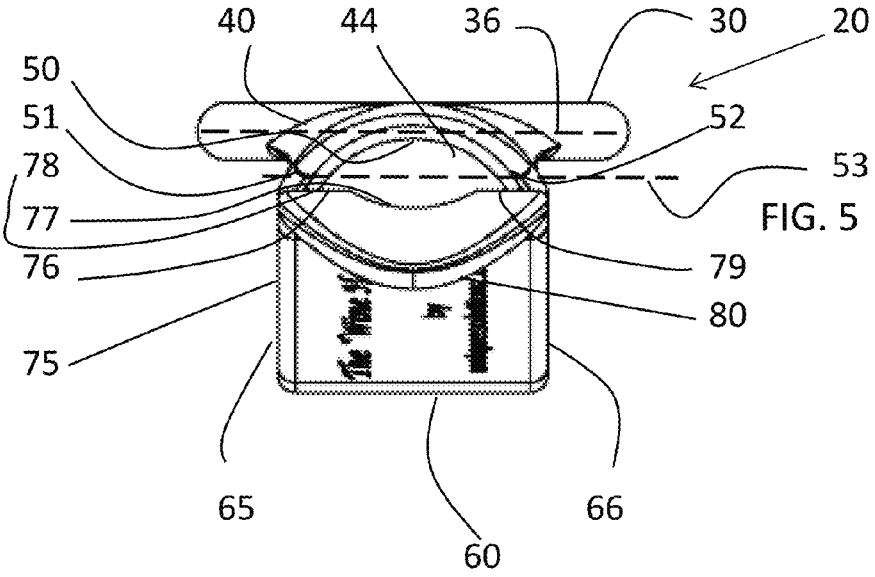
FIG. 5 is an end view of the preferred embodiment of the present invention illustrated in FIG. 2.
Figure 6:
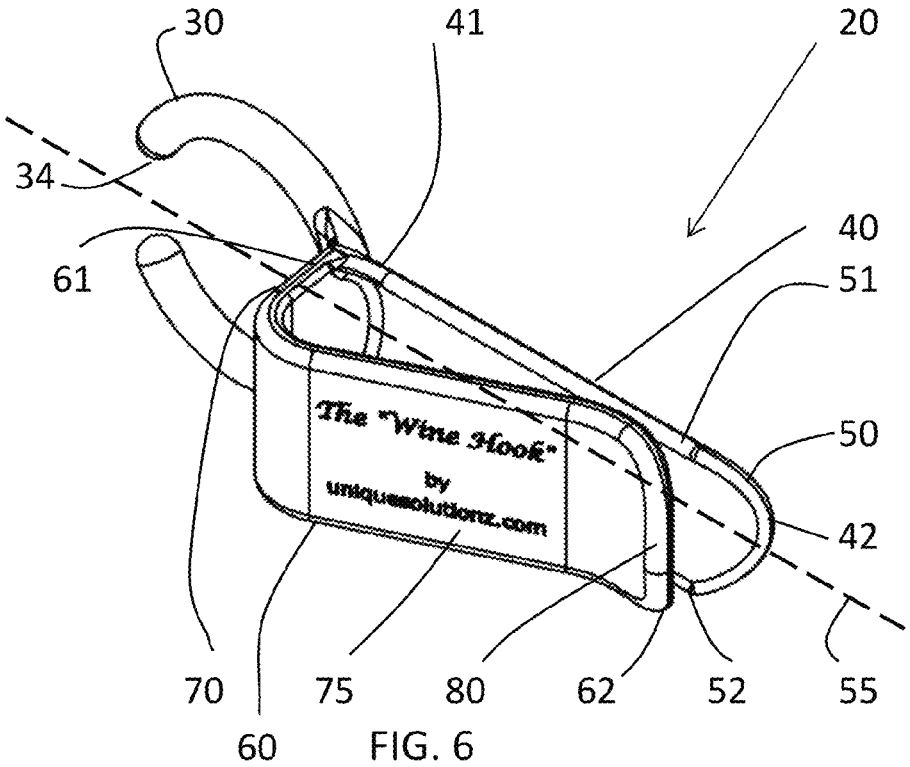
FIG. 6 is a perspective view of the preferred embodiment of the present invention illustrated in FIG. 2.
Figure 7:
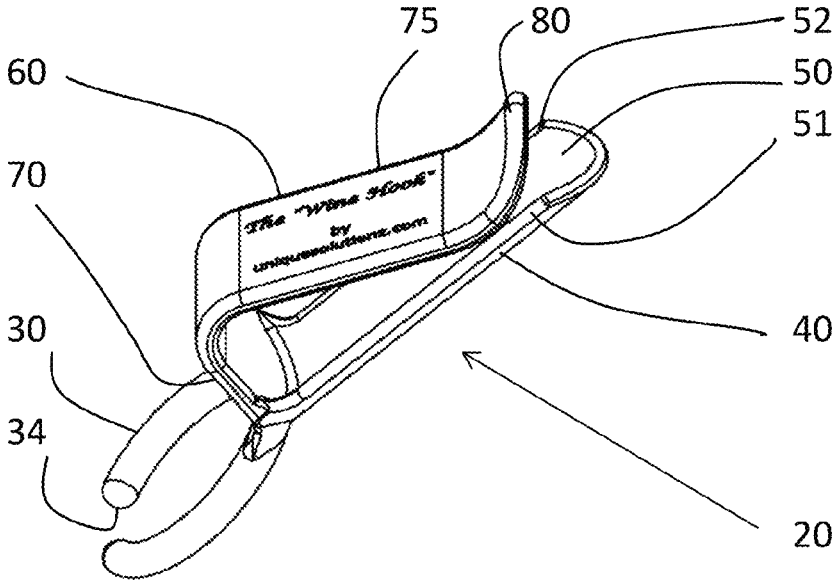
FIG. 7 is a perspective view of the preferred embodiment of the present invention illustrated in FIG. 2.
Figure 8:
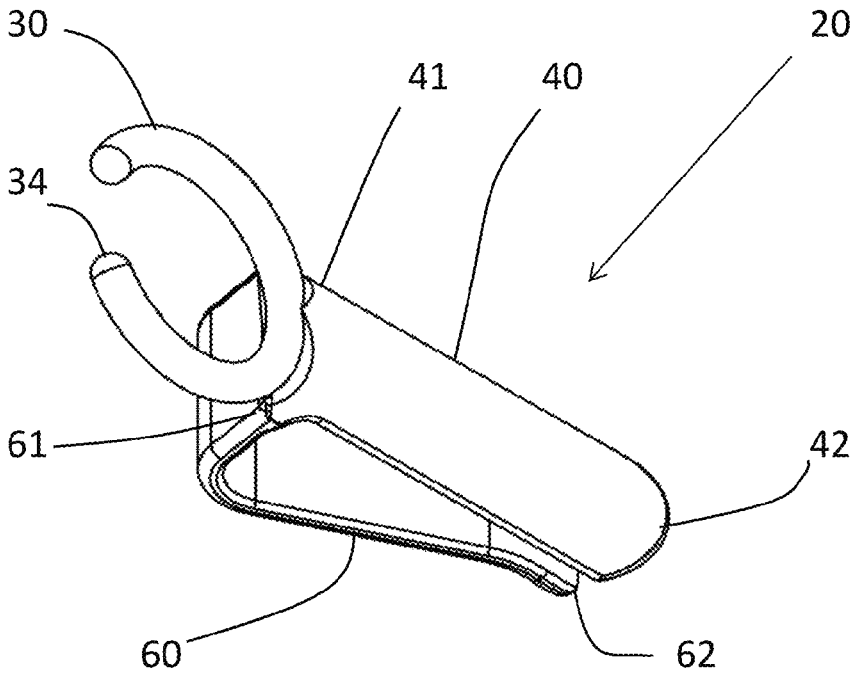
FIG. 8 is a perspective view of the preferred embodiment of the present invention illustrated in FIG. 2.
Figure 9:
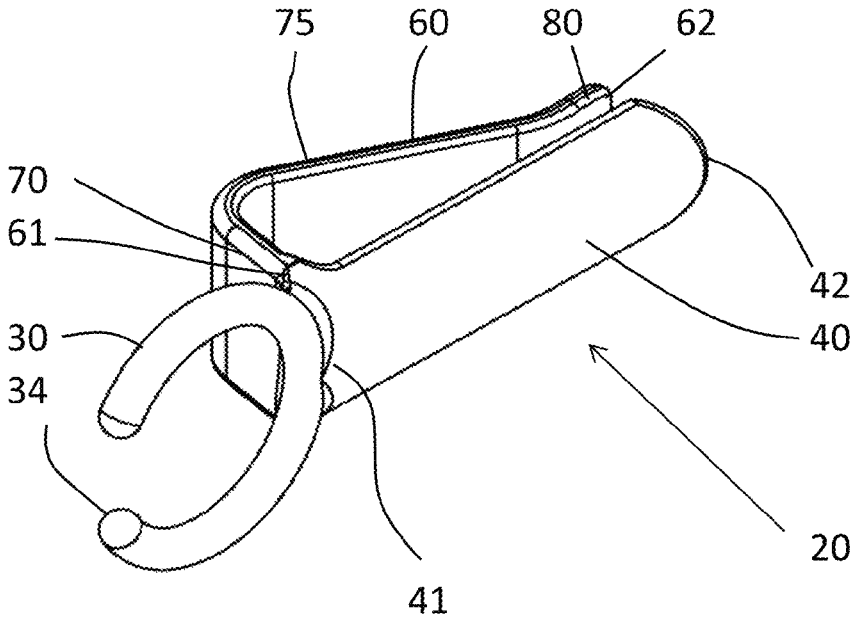
FIG. 9 is a perspective view of the preferred embodiment of the present invention illustrated in FIG. 2.

The present invention is useful to hold a glass 1 with a stem 2 and a body 3 for receiving a fluid such as wine. In use, the invention can be used with a camp or outdoor style chair 5 having an arm 6 made of fabric 7. The end of the arm 6 is supported by an arm bar 8. The arm bar 8 is a generally round bar that is part of a folding framework. The arm bar is a rigid member and generally extends perpendicular across the arm at an end of the arm. Typically, the arm 6 has a circular pocket useful for cans and bottles, but which of little use for stemmed glassware. The arm fabric 7 is generally flexible and is unsuitable for supporting a stemmed glass in an upright manner. An example of this type of chair is illustrated in FIG. 1.

Figure 10:
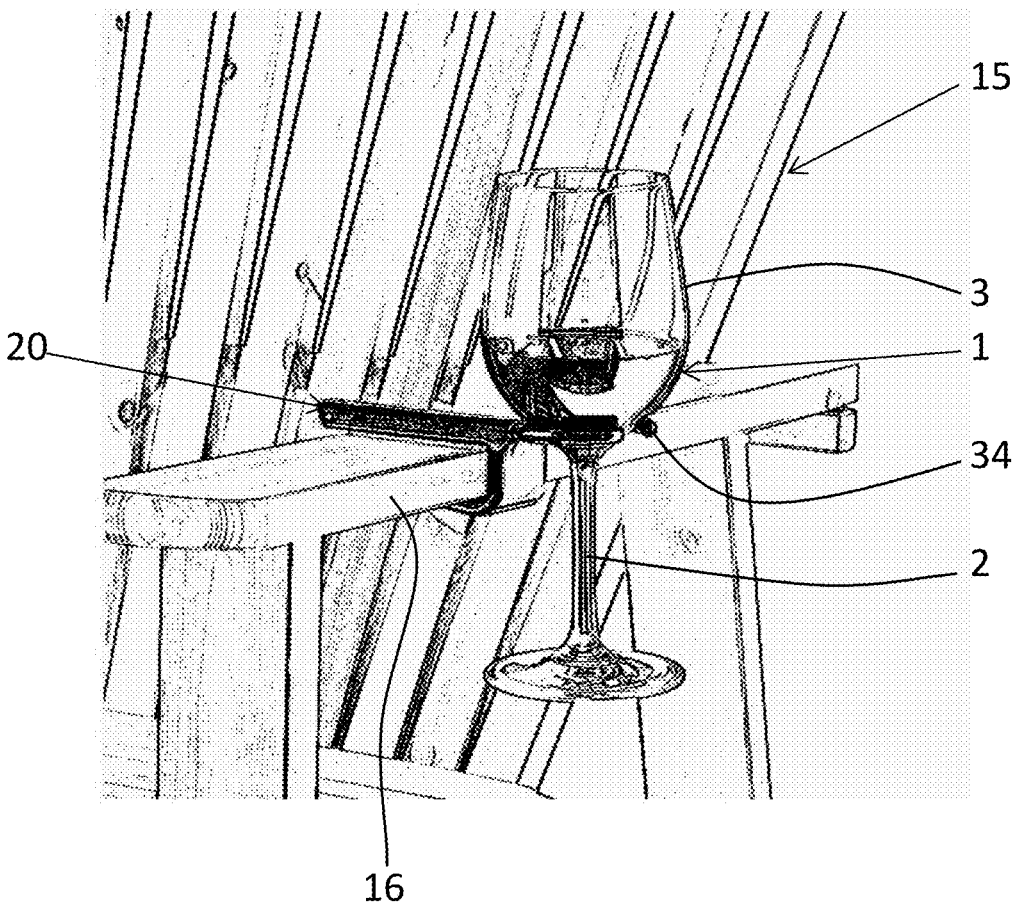
FIG. 10 is a view of the preferred embodiment of the present invention illustrated in FIG. 2 in an alternative preferred environment.
Figure 11:
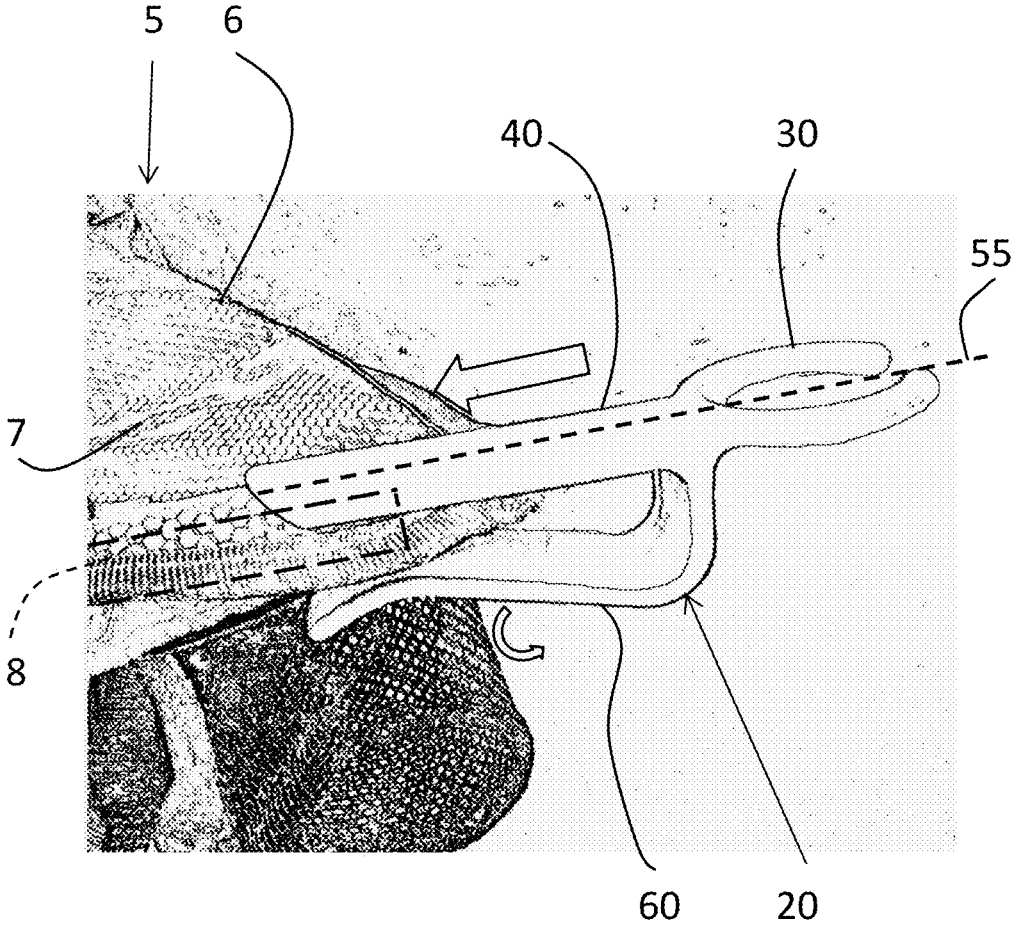
FIG. 11 is a view of the preferred embodiment of the present invention illustrated in FIG. 2 shown being attached to an object.
Figure 12:
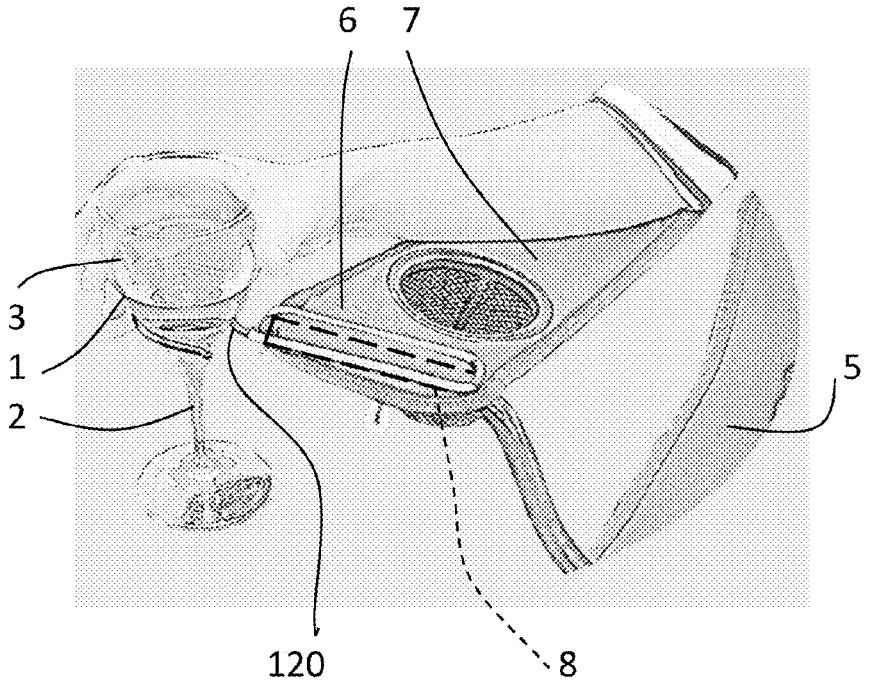
FIG. 12 is a view of an alternative preferred embodiment of the present invention shown in an intended environment.
Figure 13:
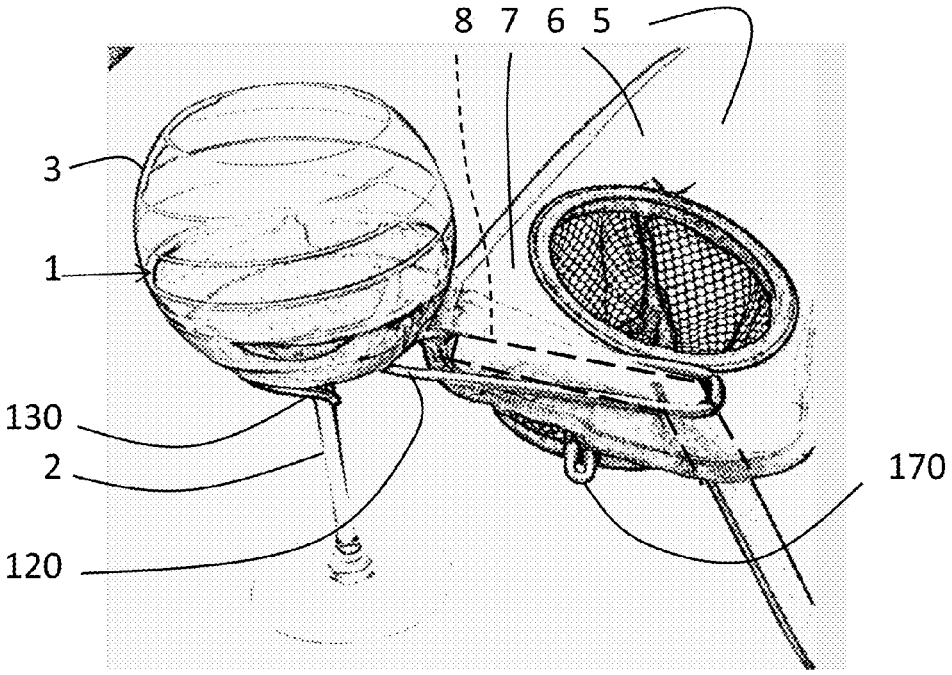
FIG. 13 is an alternative view of the alternative preferred embodiment of the present invention illustrated in FIG. 12.

The present invention is also useful with other types of chairs such as a chair 15 having a flat arm 16 that is made of a rigid material such as wood. An example of this type of chair 15 is illustrated in FIG. 10.

Of course, the present invention can be used with many types of objects having a flat, round or other profile surface without departing from the broad aspects of the present invention. For example, the present invention could be used with a table having a wide range of thicknesses.

Looking now specifically to FIGS. 1-11, it is seen that a first preferred embodiment of a device 20 is provided. The device has a holder 30, a top piece 40 and a bottom piece 60. The holder 30, top piece 40 and bottom piece 60 are preferably made of a single piece of material such as plastic. However, it is understood that other materials could be used without departing from the broad aspects of the present invention. Each of these components is described below.

The holder 30 has a top 31, a bottom 32, a continuous segment 33 with an opening 34, a center 35. The holder 30 lies in a holder plane 36. The holder is preferably generally circular or ring shaped, and can have a generally round profile. The opening 34 is preferably at the remote or distal end of the device and is wide enough to allow a stem 2 to pass through it. Yet, it is appreciated that the opening 34 could be located elsewhere around the holder 30 without departing from the broad aspects of the present invention. The round body of the glass rests upon the top of the generally ring shaped holder. It is preferred that the continuous segment 33 of the holder 30 spans more than 50% of the perimeter of the holder and that the opening 34 spans less than 50% of the perimeter.

The top piece 40 has opposed ends 41 and 42, a top 43, a bottom 44 and opposed sides 45 and 46. The top piece 40 has an arch 50 on the bottom 44. The bottom 44 could also be described as the inside or inside portion of the top piece 40. The arch preferably has an arcuate shape and ends with two parallel side rails 51 and 52, or rails, that lie in a rail plane 53. Rail plane 53 is preferably generally parallel to holder plane 36. While the preferred arch 50 is generally arcuate, it is appreciated that other shapes such as box shaped, polygonal or some combination thereof may be used without departing from the broad aspects of the present invention. The arch 50 preferably spans along a longitudinal axis 55 and is centrally located between sides 45 and 46 of the top piece 40. The top piece 40, preferably due to the arch, is a generally rigid piece.

The center of the arch 50 is preferably collinear with the center 35 of the holder 30. The center of gravity of the contents of the glass are geometrically aligned with the center of the holder 30. In this regard, the glass and its contents do not apply any rotational forces (perpendicular to the arm bar axis) and instead are supported in line with the arch longitudinal axis.

The bottom piece 60 has opposed ends 61 and 62, a top 63 and a bottom 64 and opposed sides 65 and 66. The bottom piece has a depending portion 70 at the second end 61 that is preferably integral with the second end 42 of the top piece. The depending portion 70 is angled away from the first piece preferably between 5 and 15 degrees (illustrated at approximately 10 degrees). Yet, it is appreciated that this angle could be greater or smaller without departing from the broad aspects of the present invention. A return portion 80 is also provided. The return portion has one end integral with the depending portion and a contacting end 76 remote from the depending portion. The contacting end 76 has a notch 77 between two flat sections 78 and 79, respectively. The flat sections 78 and 79 preferably lie in a plane that is parallel to the rail plane 53. The notch 77 is preferably centrally located on the contacting end between the flat sections 78 and 79 and can have a round or other shaped profile. The center of the notch 77 is preferably linearly aligned with the center of the arch. The return portion is preferably generally perpendicular to the depending portion. However, this angle between the depending portion and return portion can be greater or smaller without departing from the broad aspects of the present invention. An engagement portion 80 is further provided. The engagement portion 80 is angled away from the top piece in a divergent manner whereby the device easily can engage an object.

The bottom piece is preferably generally wide and thin. In this regard, the bottom piece 60 is generally flexible and acts as a spring. The bottom piece accordingly is a spring piece (while the top piece is a rigid piece).

In use, the device 20 is first spread apart via separating the second end 62 of the bottom piece 60 from the top piece 40 in a flexing manner relative to the first end 61 along the length of the bottom piece 60. Then, the device 20 is inserted, slid or moved longitudinally along the longitudinal axis 55 of the arch 50 over or relative to an object wherein the top piece 40 is over the object and the bottom piece 60 is below the object. Then the spring force is released and the object is clamped between the top and bottom pieces 40 and 60, respectively, under the spring force of the spring or bottom piece. It is understood that the object could be a chair or other object without departing from the broad aspects of the present invention. When clamping onto a chair, the arm bar is engaged (through the fabric) between the arch and the notch and also is centered relative thereto. When clamping onto a flat surface, the object is engaged between the rails and the flat portion of the engagement portion of the bottom piece in a four point engagement. The present invention can preferably be used with objects up an inch in thickness. Yet, it is understood that the present invention could be made larger or smaller without departing from the broad aspects of the present invention. Regardless of what the device 20 is clamped onto, the holder plane 36 is preferably generally parallel to the longitudinal axis 55 of the arch 50.

A glass 1 is then inserted in the holder 30 by passing the stem 2 through the opening 34. The body 3 of the glass 1 can then rest on the top 31 of the holder 30.

The device is resistant to twisting relative to the object. This is because the weight of the glass 1 and its contents are held at a location aligned with the longitudinal axis 55 of the arch 50. Since the arch 50 is centered over the arm bar, the load is supported in line with the arm bar 8 whereby no twisting forces are developed that would act perpendicular to the arm bar.

Turning now to FIGS. 12-20, it is seen that an alternative preferred embodiment of a device 120 is illustrated. The device has a holder 130, a top piece 135 and a bottom piece 155. The device 120 is preferably made of a continuous piece of round material such as a wire frame. The material can be metal, plastic or any other suitable material that can be elastically deformed to create a spring force.

The holder 130 has a top 131, a bottom 132 and a neck 133. The holder 130 lies in a holder plane 134. The neck 133 is located at one end of the continuous structure. Geometrically, the neck is located next to an end of the top piece 135. The holder 130 has a center.

Figure 14:
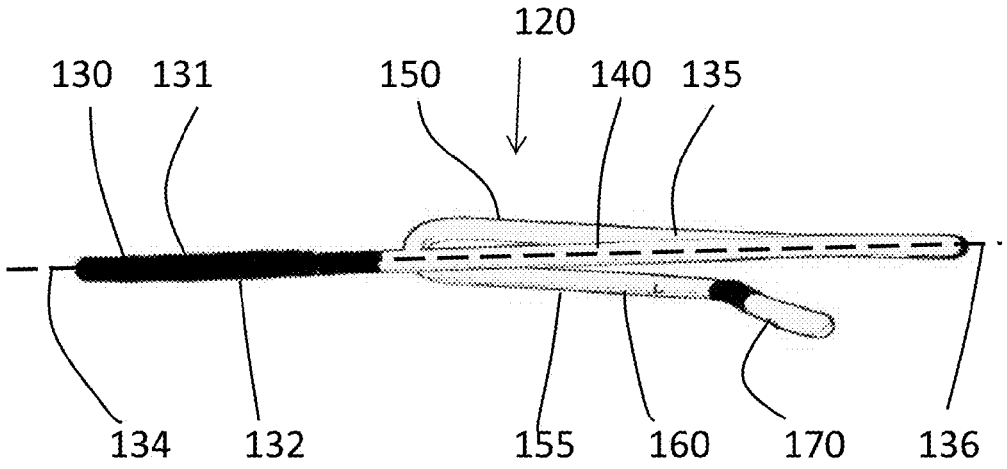
FIG. 14 is a side view of the embodiment illustrated in FIG. 12.
Figure 15:
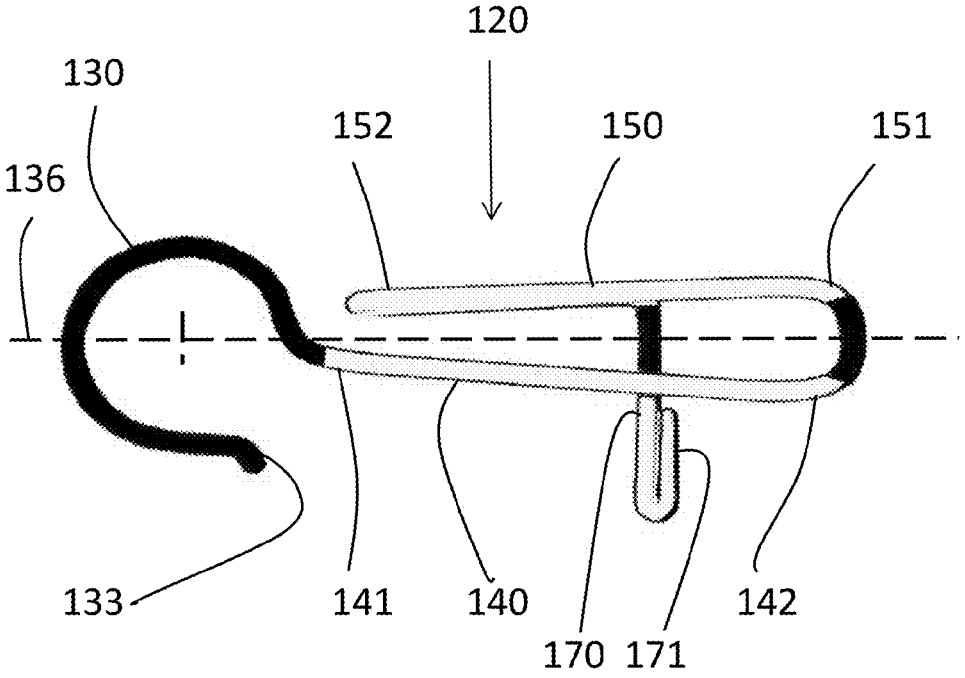
FIG. 15 is a top view of the embodiment illustrated in FIG. 12.
Figure 16:
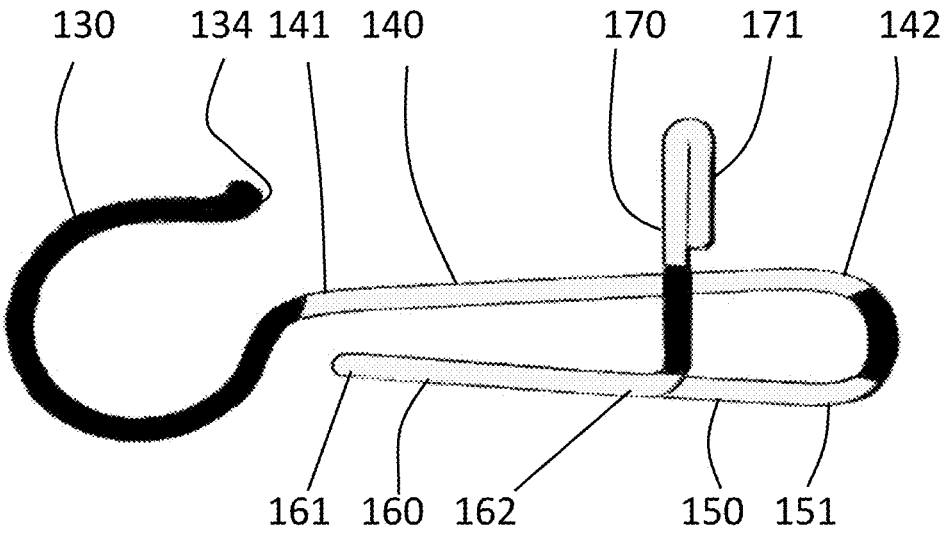
FIG. 16 is a bottom view of the embodiment illustrated in FIG. 12.
Figure 17:
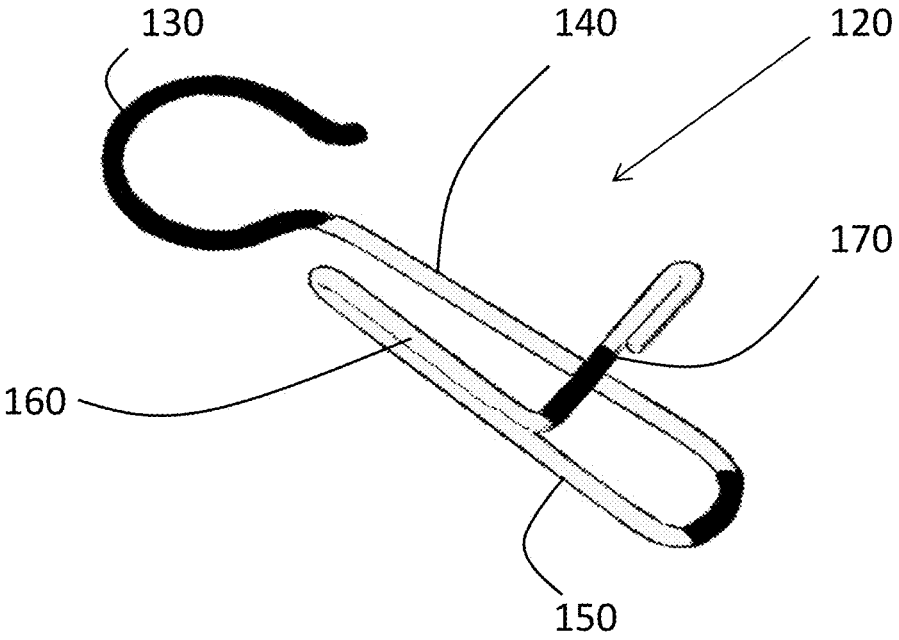
FIG. 17 is a perspective view of the embodiment illustrated in FIG. 12.
Figure 18:
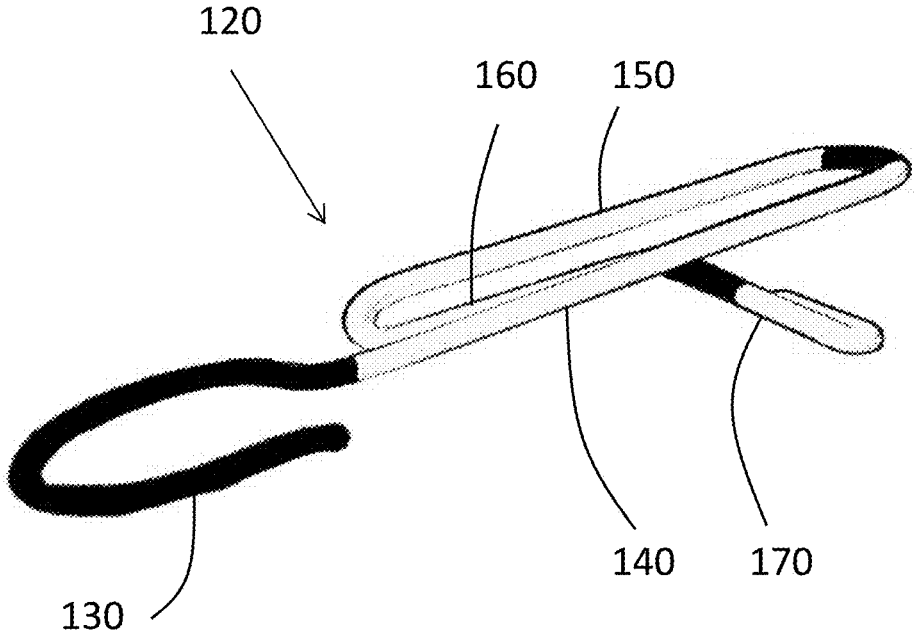
FIG. 18 is a perspective view of the embodiment illustrated in FIG. 12.
Figure 19:
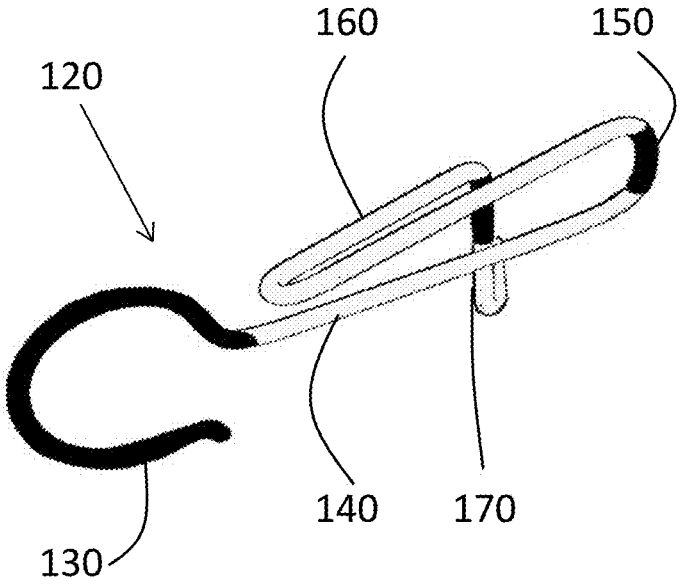
FIG. 19 is a perspective view of the embodiment illustrated in FIG. 12.

The top piece 135 has a first arm 140 with ends 141 and 142 and a second piece 150 with ends 151 and 152. The first arm 140 connects to the holder 130 at end 141. The second arm is connected to the first arm. The top piece has a longitudinal axis 136 that is parallel to the first arm when the device 20 is not in use as seen in FIG. 14. The longitudinal axis is generally parallel with the holder plane 134. The top piece has a geometric center between the first arm 140 and second arm 150. The geometric center is aligned with the center of the holder whereby the weight of items held in the holder are distributed along the geometric center of the top piece to the arm bar.

The bottom piece 155 has a third arm 160 with ends 161 and 162. The third arm is connected to the second arm. A lever 170 with a hook 171 is also provided and is connected to the second end 162 of the third arm 160. The third arm 160 is preferably shorter than the first arm 140 and second arm 150. The lever 170 is preferably located closer towards the connection of the first and second arms than it is towards the connecting of the second and third arms. The third arm and the lever are a spring. The lever is preferably generally perpendicular to the third arm whereby it can be engaged to spread the third arm from the second arm (and hence the bottom piece 155 from the top piece 135).

Figure 20:
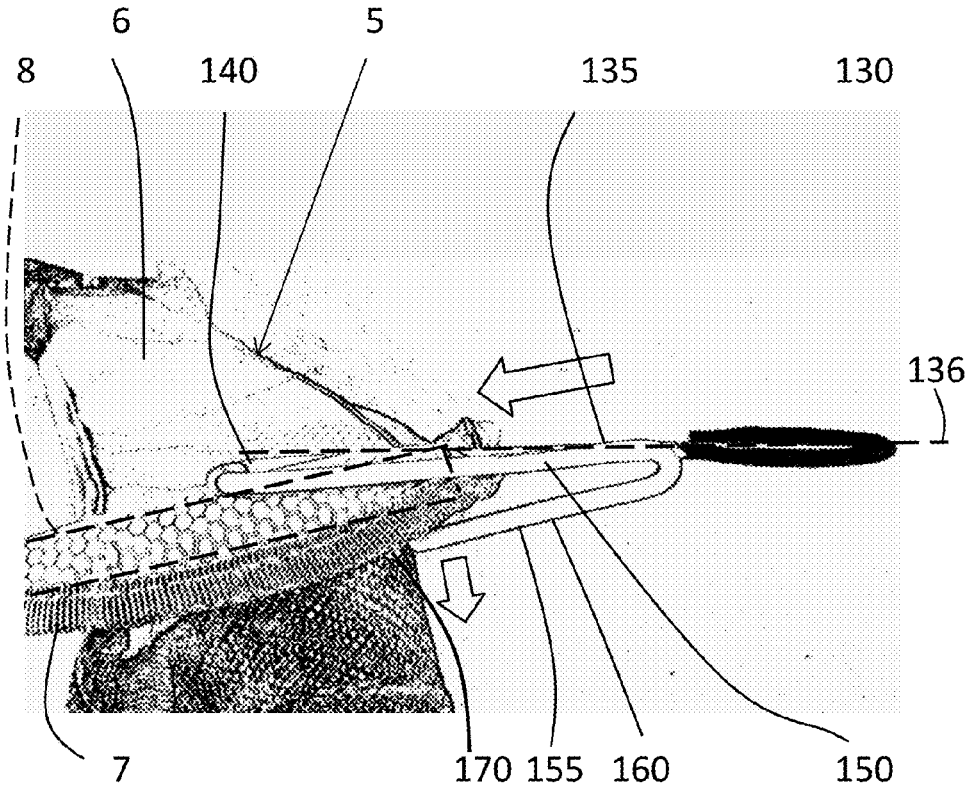
FIG. 20 is a perspective view of the embodiment illustrated in FIG. 12 shown being attached to an object.

The lever can be used to increase the distance between the third arm 160 and both of the first and second arms 140 and 150, respectively. In this regard, the device 120 can engage an arm bar 8 of a chair by forcing the spring apart and longitudinally placing the device over and below the arm bar of a chair 5 as seen in FIG. 20. The top piece contacts the fabric 7 around the arm bar 8 to engage the arm bar. Specifically, the first arm and the second arm engage the fabric on each side of the arm bar. Then, the lever 170 is released and it contacts the fabric at the bottom of the arm bar in a perpendicular manner to engage the arm bar.

Thus it is apparent that there has been provided, in accordance with the invention, an invention that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A device removably connectable to an object for holding a stemmed glass, said device comprising:

a holder with an opening that is adapted to receive a stem of the stemmed glass, said holder lying in a holder plane;

a top piece with a top piece length, said top piece having a longitudinal axis that is fixed in an orientation that is parallel with said holder plane, said longitudinal axis extending along said top piece length; and a bottom piece, wherein said device is movable along said longitudinal axis onto the object, wherein said top piece has a first end, a second end and a bottom that has an arch, said arch extending longitudinally to said second end located opposite of said opening wherein said arch is capable of engaging the object along said longitudinal axis of said top piece, and wherein said arch has a first arch side rail and a second arch side rail, said first arch side rail and said second arch side rail being generally parallel to said longitudinal axis.

2. The device of claim 1 wherein said bottom piece has a notch formed therein, said notch being generally aligned with said arch wherein said arch and said notch can cooperatively engage the object.

3. The device of claim 1 further comprising a spring.

4. The device of claim 3 wherein said holder, said top piece and said bottom piece are integrally formed.

5. The device of claim 4 wherein said bottom piece is said spring and said top piece is a generally rigid top piece.

6. A device for attaching to an arm bar of a chair for holding a stemmed glass, said device comprising:

a holder with an opening that is adapted to receive a stem of the stemmed glass;

a top piece having a longitudinal axis, a top piece first end, a top piece second end and an arch, said arch extending through said top piece second end which is opposite of said holder; and a bottom piece, wherein:

said device is movable relative to the arm bar along said longitudinal axis and whereby said arch can engage the arm bar along said longitudinal axis of said top piece from said second end of said top piece, said bottom piece is a spring;

said holder lies in a holder plane that is generally parallel to said longitudinal axis, and said spring has:

a depending portion that is connected to said top piece; and a return portion with a contacting end; and wherein said contacting end has a notch formed there through, said notch and said arch being adapted to engage the arm bar of the chair.

7. The device of claim 6 wherein said device is made of a single piece of material that is integrally formed.

8. A device removably connectable to an object for holding a stemmed glass, said device comprising:

a holder with an opening that is adapted to receive a stem of the stemmed glass, said holder lying in a holder plane;

a top piece having a longitudinal axis, said longitudinal axis being parallel to said holder plane, said top piece having a top piece length between a top piece first end and a top piece second end and said longitudinal axis extending along said top piece length, said top piece being generally rigid; and a bottom piece having a spring and being integral with said top piece wherein said bottom piece has a bottom piece first end and a bottom piece second end and being generally flexible so that said bottom piece second end is movable with respect to said top piece second end, wherein said device can engage the object between said top piece and said bottom piece along said longitudinal axis of said top piece, wherein said top piece has an arch, said arch extending to and open at said top piece second end, and wherein said arch has two side rails whereby said top piece selectably engages either a flat surface or a round surface.

9. The device of claim 8 wherein said bottom piece has a depending portion and a return portion with a contacting end, said contacting end having a notch, said notch being generally aligned with said arch.

10. A device removably connectable to an object for holding a stemmed glass, said device comprising:

a holder with an opening that is adapted to receive a stem of the stemmed glass, said holder lying in a holder plane;

a top piece having a longitudinal axis that is fixed in an orientation that is generally parallel with said holder plane; and a bottom piece having a notch formed therein, said notch being generally aligned with an arch wherein said arch and said notch can cooperatively engage the object, wherein said device is movable along said longitudinal axis onto the object.

11. A device removably connectable to an object for holding a stemmed glass, said device comprising:

a holder with an opening that is adapted to receive a stem of the stemmed glass, said holder lying in a holder plane;

a top piece having a longitudinal axis, said longitudinal axis being generally parallel to said holder plane, said top piece further having a top piece first end, a top piece second end and an arch, said arch extending to and being open at said top piece second end and wherein said top piece is a rigid piece; and a bottom piece having a spring and being integral with said top piece, wherein said device can engage the object between said top piece and said bottom piece along said longitudinal axis of said top piece.

12. A device removably connectable to an object for holding a stemmed glass, said device comprising:

a holder with an opening that is adapted to receive a stem of the stemmed glass, said holder lying in a holder plane;

a top piece with a top piece length, said top piece having a longitudinal axis that is fixed in an orientation that is parallel with said holder plane, said longitudinal axis extending along said top piece length; and a bottom piece, wherein said device is movable along said longitudinal axis onto the object, and wherein said top piece has a first end, a second end and a bottom that has an arch, said arch extending longitudinally to said second end located opposite of said opening wherein said arch is capable of engaging the object along said longitudinal axis of said top piece, and wherein said bottom piece has a notch formed therein, said notch being generally aligned with said arch wherein said arch and said notch can cooperatively engage the object.

13. A device removably connectable to an object for holding a stemmed glass, said device comprising:

a holder with an opening that is adapted to receive a stem of the stemmed glass, said holder lying in a holder plane;

a top piece with a top piece length, said top piece having a longitudinal axis that is fixed in an orientation that is parallel with said holder plane, said longitudinal axis extending along said top piece length; and a bottom piece, wherein:

said device is movable along said longitudinal axis onto the object, said top piece has a first end, a second end and a bottom that has an arch, said arch extending longitudinally to said second end located opposite of said opening wherein said arch is capable of engaging the object along said longitudinal axis of said top piece, said device further comprises a spring, said holder, said top piece and said bottom piece are integrally formed, and said bottom piece is said spring and said top piece is a generally rigid top piece.

* * * * *